US009440329B2

(12) United States Patent
Sawada

(10) Patent No.: US 9,440,329 B2
(45) Date of Patent: Sep. 13, 2016

(54) SHOT PEENING METHOD WITH WHICH HIGH COMPRESSIVE RESIDUAL STRESS IS OBTAINED

(71) Applicant: Sanyo Special Steel Co., Ltd., Himeji-shi, Hyogo (JP)

(72) Inventor: Toshiyuki Sawada, Himeji (JP)

(73) Assignee: Sanyo Special Steel Co., Ltd., Hyogo (JP)

( * ) Notice: Subject to any disclaimer, the term of this patent is extended or adjusted under 35 U.S.C. 154(b) by 0 days.

(21) Appl. No.: 14/787,336

(22) PCT Filed: Apr. 28, 2014

(86) PCT No.: PCT/JP2014/061840
§ 371 (c)(1),
(2) Date: Oct. 27, 2015

(87) PCT Pub. No.: WO2014/178367
PCT Pub. Date: Nov. 6, 2014

(65) Prior Publication Data

US 2016/0107292 A1 Apr. 21, 2016

(30) Foreign Application Priority Data

Apr. 30, 2013 (JP) ..... 2013-095582

(51) Int. Cl.
*B24C 1/10* (2006.01)
*B24C 11/00* (2006.01)

(52) U.S. Cl.
CPC *B24C 1/10* (2013.01); *B24C 11/00* (2013.01)

(58) Field of Classification Search
CPC ..... B24C 1/10; B24C 11/00
USPC ..... 72/53
See application file for complete search history.

(56) References Cited

U.S. PATENT DOCUMENTS 5,916,383 A 6/1999 Rokutanda et al.
8,151,613 B2 4/2012 Ishikura et al.

(Continued)

FOREIGN PATENT DOCUMENTS

JP 1029160 A 2/1998
JP 10100069 A 4/1998
JP 10118930 A 5/1998

(Continued)

OTHER PUBLICATIONS

Kimura et al., "Thermal Stability of Ultrafine Grained Ferritic Structure of Iron with Oxide Particles," Ultrafine Grain Materials, edited by Mishra et al., TMS, pp. 277-286 (2000).

*Primary Examiner* — David B Jones
(74) *Attorney, Agent, or Firm* — The Webb Law Firm

(57) ABSTRACT

A shot peening process involves the steps of providing a steel member having a surface with a Vickers hardness of 920 HV or more and projecting a shot against the steel member, the shot having a Vickers hardness of 1000 HV or more and a density of 5.5 Mg/m$^3$ or more. The shot satisfies the relationship $HV_{shot} \geq 0.4 \times HV_{steel} + 620$, where $HV_{shot}$ is the Vickers hardness (HV) of the shot, and $HV_{steel}$ is the Vickers hardness (HV) of the surface of the steel member. The resulting steel member has an unprecedentedly high compressive residual stress of 2,200 MPa or more.

9 Claims, 1 Drawing Sheet

(56) References Cited

U.S. PATENT DOCUMENTS

| | | | | |
|---|---|---|---|---|
| 2013/0247633 | A1* | 9/2013 | Nozaki | B24C 1/10 72/53 |
| 2016/0114462 | A1* | 4/2016 | Kecskes | B24C 1/10 72/53 |

FOREIGN PATENT DOCUMENTS

| | | | |
|---|---|---|---|
| JP | 2009131912 | A | 6/2009 |
| JP | 201136949 | A | 2/2011 |
| JP | 2012139790 | A | 7/2012 |

* cited by examiner

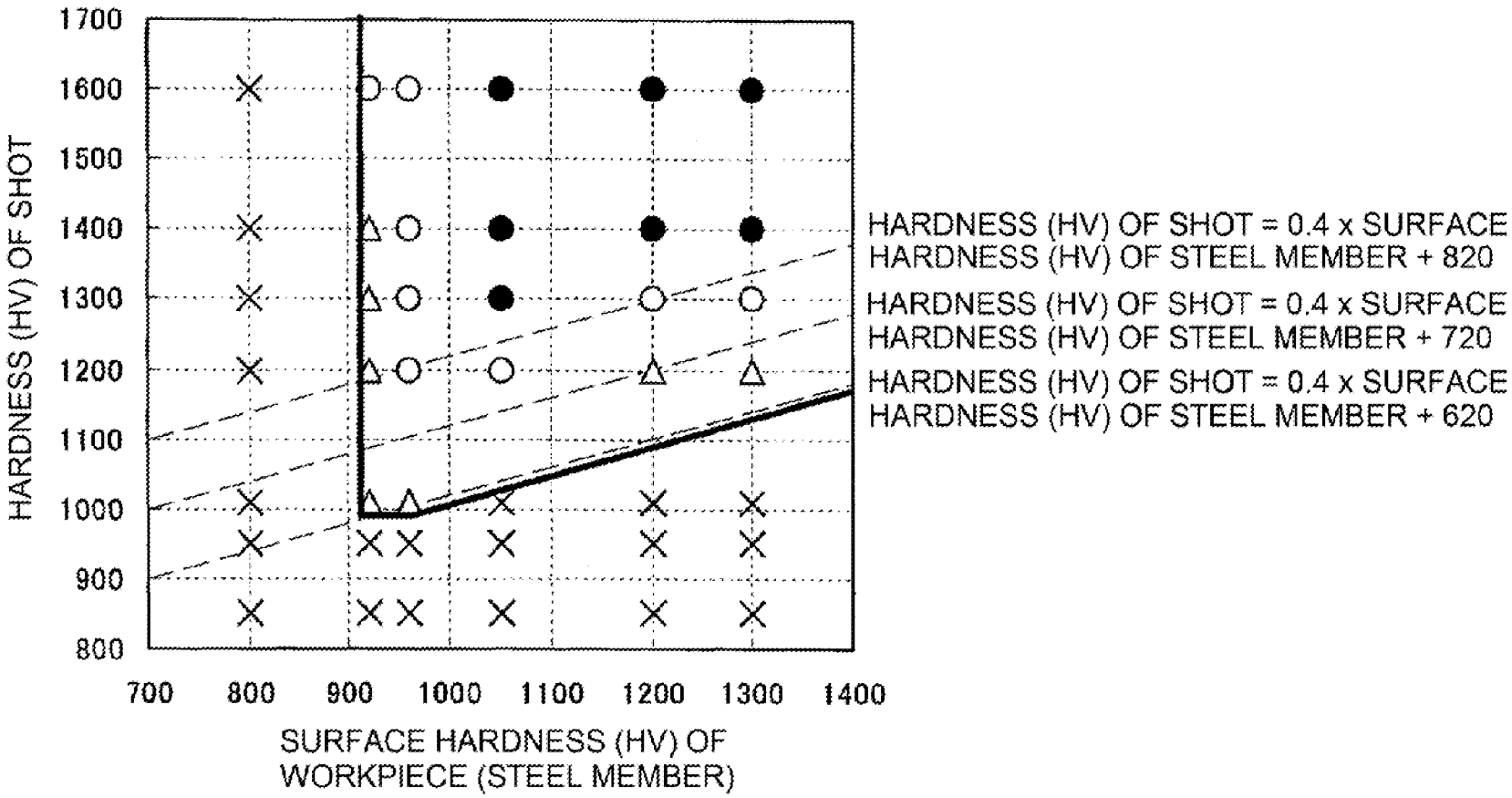
HARDNESS (HV) OF SHOT = 0.4 x SURFACE HARDNESS (HV) OF STEEL MEMBER + 820
HARDNESS (HV) OF SHOT = 0.4 x SURFACE HARDNESS (HV) OF STEEL MEMBER + 720
HARDNESS (HV) OF SHOT = 0.4 x SURFACE HARDNESS (HV) OF STEEL MEMBER + 620
HARDNESS (HV) OF SHOT
1700
1600
1500
1400
1300
1200
1100
1000
900
800
700
800
900
1000
1100
1200
1300
1400
SURFACE HARDNESS (HV) OF WORKPIECE (STEEL MEMBER)

SHOT PEENING METHOD WITH WHICH HIGH COMPRESSIVE RESIDUAL STRESS IS OBTAINED

CROSS-REFERENCE TO RELATED APPLICATIONS

This application is the United States national phase of International Application No. PCT/JP2014/061840 filed Apr. 28, 2014, and claims priority to Japanese Patent Application No. 2013-095582 filed Apr. 30, 2013, the disclosures of which are hereby incorporated in their entirety by reference.

BACKGROUND OF THE INVENTION

1. Technical Field

The present invention relates to shot peening processes for providing high-strength steel members for use in various high-strength parts and dies, particularly to a shot peening process for providing an unprecedentedly high compressive residual stress of 2,200 MPa or more.

2. Background Art

In order to prolong the service lives of various high-strength parts and dies, the surfaces of the high-strength parts and dies have been strengthened by various heat treatment processes such as induction hardening, carburizing, carbonitriding, and nitriding and shot peening processes under various conditions. For example, JP2009-131912A (Patent Document 1) discloses the surface hardening of a steel material by eutectoid vacuum carburizing and then shot peening of the hardened material with a shot having a higher hardness to apply a high compressive residual stress of 1,800 MPa or more.

Recently, various high-strength parts and dies have been used in even severer environments, and there has been an urgent need for the development of a technology that allows for further strengthening of the components and the application of a higher compressive residual stress. Unfortunately, conventional combinations of shots and workpieces to be shot-peened result in a compressive residual stress below 2,200 MPa. This is due to the insufficient hardness of both the shot and the workpieces. The surfaces of materials subjected to general shot peening processes also soften noticeably when they are used in applications involving a temperature increase, such as gears and molds.

CITATION LIST

Patent Document

Patent Document 1: JP2009-131912A

Non-Patent Document

Non-Patent Document 1: Y. Kimura, S. Nakamyo, H. Hidaka, H. Goto, and S. Takaki, Ultrafine Grained Materials, edited by R. S. Mishra, S. L. Semiatin, C. Suryanarayana, N. N. Thadhani, and T. C. Lowe, TMS (2000), pp. 277-286

SUMMARY OF INVENTION

The inventors have discovered that the use of a shot having high hardness and a workpiece having high hardness, specifically, the shot peening of a workpiece having a Vickers hardness of 920 HV or more with a shot having a Vickers hardness of 1000 HV or more, which has never been reported before, provides an unprecedentedly high compressive residual stress of 2,200 MPa or more.

Accordingly, an object of the present invention is to provide a shot peening process that allows for an unprecedentedly high compressive residual stress of 2,200 MPa or more.

An aspect of the present invention provides a shot peening process comprising the steps of:

providing a steel member having a surface with a Vickers hardness of 920 HV or more; and projecting a shot against the steel member, the shot having a Vickers hardness of 1000 HV or more and a density of 5.5 $Mg/m^3$ or more, and the shot satisfying the following relationship:

$$HV_{shot} \geq 0.4 \times HV_{steel} + 620$$

wherein $HV_{shot}$ is the Vickers hardness (HV) of the shot, and $HV_{steel}$ is the Vickers hardness (HV) of the surface of the steel member.

BRIEF DESCRIPTION OF DRAWING

FIG. 1 is a graph showing the relationship between the surface hardness of workpieces (steel members) and the hardness of shots.

DESCRIPTION OF EMBODIMENTS

A shot peening process according to the present invention involves providing a steel member having a surface with a Vickers hardness of 920 HV or more and projecting a shot against the steel member, the shot having a Vickers hardness of 1000 HV or more and a density of 5.5 $Mg/m^3$ or more. The shot satisfies the relationship $HV_{shot} \geq 0.4 \times HV_{steel} + 620$, where $HV_{shot}$ is the Vickers hardness (HV) of the shot, and $HV_{steel}$ is the Vickers hardness (HV) of the surface of the steel member. This process achieves a significantly high compressive residual stress of 2,200 MPa or more, which has never been achieved by conventional processes. Another advantage is that the resulting steel member exhibits a small decrease in surface hardness after heat exposure at or below about 500° C.

Although the exact mechanism is not fully understood, such a small decrease in surface hardness after heat exposure can be assumed as follows. The surface of a workpiece treated by the shot peening process according to the present invention is considered to be hardened through the nanocrystallization of crystal grains. Such hard mechanical working that induces nanocrystallization of crystal grains in workpieces is termed severe plastic deformation. It is believed that the phenomenon caused by the process according to the present invention is similar to those caused by severe plastic deformation processes such as mechanical milling, accumulative roll-bonding (ARB), high-pressure torsion (HPT), and equal-channel angular pressing (ECAP).

It is pointed out that a material composed of nanocrystalline grains formed by severe plastic deformation may contain oversaturated amounts of interstitial elements such as oxygen and carbon present between the nanocrystalline grains, and after heat exposure, these elements may precipitate between the nanocrystalline grains in the form of ultrafine grains of compounds, which may pin the nanocrystalline grains, thereby inhibiting the formation of coarse crystal grains and reducing the decrease in hardness after heat exposure (for example, Non-Patent Document 1 (Y. Kimura, S. Nakamyo, H. Hidaka, H. Goto, and S. Takaki, Ultrafine Grained Materials, edited by R. S. Mishra, S. L. Semiatin, C. Suryanarayana, N. N. Thadhani, and T. C. Lowe, TMS (2000), pp. 277-286)). A similar phenomenon presumably occurs on the surface treated by the shot peening process according to the present invention.

A temperature increase occurs during tests such as roller pitting fatigue tests and heat check tests on dies; therefore, it is advantageous that an increase in temperature results in a small decrease in hardness. A steel member that exhibits a small decrease in surface hardness after heat exposure as provided by the present invention is superior in these properties and is particularly suitable for use as various fatigue members associated with a temperature increase and warm and hot working dies.

A typical shot has a particle size of 0.02 to 1 mm. In the present invention, shots having such particle sizes can be used. In shot peening, a workpiece is generally shot-peened with a shot at various projection speeds as needed. In the present invention, shot peening can be performed under common projection conditions. For example, a typical air shot peening system performs shot peening at a projection pressure of 0.2 to 0.8 MPa. In the present invention, shot peening can be performed at such projection pressures.

The steel member used in the process according to the present invention has a surface with a Vickers hardness of 920 HV or more, preferably more than 950 HV, more preferably more than 1000 HV. In the present invention, the surface hardness of the steel member to be shot-peened affects the magnitude of the resulting compressive residual stress. Specifically, it is considered that a high compressive residual stress is achieved only at a site with high hardness. The resulting compressive residual stress is low if the surface hardness is less than 920 HV. If a steel member is subjected to treatment such as nitriding to achieve high surface hardness, a compound layer made of nitride (i.e., a white layer) may form on the treated surface. This phase is significantly brittle and is partially broken by shot peening; therefore, a high compressive residual stress is not achieved at this site. In this case, the matrix phase directly below the compound layer must have a Vickers hardness of 920 HV or more. Although no upper limit is defined to the Vickers hardness of the surface of the steel member because the compressive residual stress tends to increase with the hardness, steel members having a hardness of more than 1300 HV are generally not readily available.

The shot used in the process according to the present invention has a Vickers hardness of 1000 HV or more, preferably more than 1100 HV, more preferably more than 1200 HV, and a density of 5.5 $Mg/m^3$ or more, preferably more than 6.0 $Mg/m^3$, more preferably more than 7.0 $Mg/m^3$. In the present invention, the Vickers hardness and density of the shot affect the resulting compressive residual stress. The resulting compressive residual stress is low if the shot has a Vickers hardness of less than 1000 HV. Although no upper limit is defined to the Vickers hardness of the shot because the compressive residual stress tends to increase with the hardness, shots having a hardness of more than 1600 HV are generally not readily available. The resulting compressive residual stress is also low if the shot has a density of less than 5.5 $Mg/m^3$. It is considered that a shot having a density of less than 5.5 $Mg/m^3$ does not provide a high compressive residual stress because of its low kinetic energy. Although the shot must have a certain density, any higher density does not significantly affect the resulting compressive residual stress. Therefore, no upper limit is defined to the density of the shot, but cemented carbide shots having a density of 14.0 $Mg/m^3$ or more are generally not readily available. Cemented carbide shots, which contain rare elements such as Co and W, are also relatively costly. Thus, Fe—B-based shots are preferred.

The shot used in the process according to the present invention satisfies the relationship $HV_{shot} \geq 0.4 \times HV_{steel} + 620$, preferably $HV_{shot} > 0.4 \times HV_{steel} + 720$, more preferably $HV_{shot} > 0.4 \times HV_{steel} + 820$, where $HV_{shot}$ is the Vickers hardness (HV) of the shot, and $HV_{steel}$ is the Vickers hardness (HV) of the surface of the steel member. In the present invention, a steel member having a surface with a high Vickers hardness must be shot-peened with a shot having a higher Vickers hardness to achieve a high compressive residual stress of 2,200 MPa or more. Specifically, the compressive residual stress is low if the Vickers hardness $HV_{shot}$ of the shot used is less than $0.4 \times HV_{steel} + 620$.

EXAMPLES

The present invention is further illustrated by the following examples.

Steel members having surfaces with different Vickers hardnesses and shots having different Vickers hardnesses were prepared and were subjected to shot peening to evaluate the influence of both factors on the resulting compressive residual stress (Experiment A). Another experiment was conducted with different shot sizes and projection pressures. In this experiment, the test pieces after shot peening were subjected to heat treatment, and the Vickers hardness of the shot-peened surface was measured before and after the heat treatment (Experiment B).

Experiment A

The steel members (workpieces) shown in Table 1 and the shots shown in Table 2 were prepared. The steel members were prepared from commercially available steel materials standardized by JIS and subjected to normal heat treatment. Any compound layer formed on the surface of the steel members was removed by polishing, and the Vickers hardness was measured on the metal surface. Shot peening was performed with the compound layer remaining. The steel members had a diameter of 60 mm and a thickness of 10 mm and were shot-peened on one surface with a diameter of 60 mm.

The cast steel shot and the zirconia shot were commercially available. The Fe—B-based shots were prepared by forming powders having the compositions shown in Table 2 (where % is by mass) by gas atomization and then classifying the powders. All shots had a particle size of 0.1 mm. Shot peening was performed using a suction-type air shot peening system at a projection pressure of 0.6 MPa for a projection time of 10 seconds. The compressive residual stress in the shot-peened surfaces of the steel member test pieces was measured by an X-ray diffraction technique. The test pieces were polished in steps of 10 μm from the original shot-peened surface by electropolishing, and the compressive residual stress at each depth was measured.

A test piece having a peak compressive residual stress of 2,800 MPa or more was rated as excellent. A test piece having a peak compressive residual stress of 2,500 MPa or more and less than 2,800 MPa was rated as good. A test piece having a peak compressive residual stress of 2,200 MPa or more and less than 2,500 MPa was rated as fair. A test piece having a peak compressive residual stress of less than 2,200 MPa was rated as poor. The results are summarized in FIG. 1. Since all residual stresses shown herein are compressive, the compressive residual stresses are expressed as positive values without use of negative signs.

Compressive residual stresses of 2,200 MPa or more were achieved in the region to the upper right of the black solid line in FIG. 1, which corresponds to the scope of the present invention. The compressive residual stress outside this region was less than 2,200 MPa.

TABLE 1

| No. | Material | Heat treatment | Surface hardness (HV) | Remarks |
|---|---|---|---|---|
| 1 | SCM420 | Eutectoid vacuum carburizing | 800 | Surface carbon concentration = 0.8 mass % |
| 2 | SCM822 | Eutectoid vacuum carburizing → sub-zero | 920 | Surface carbon concentration = 0.8 mass % |
| 3 | SCM822 | High-concentration vacuum carburizing → sub-zero | 960 | Surface carbon concentration = 1.8 mass % |
| 4 | SACM645 | Gas nitriding | 1050 | Compound layer thickness = 10 μm |
| 5 | SKD61 | Gas nitriding | 1200 | Compound thickness = 5 μm |
| 6 | SKD61 | Gas nitriding | 1300 | No compound layer |

TABLE 2

| No. | Material | Hardness (HV) | Density ($Mg/m^3$) |
|---|---|---|---|
| 1 | Cast steel | 850 | 7.8 |
| 2 | Fe—5.5%B | 950 | 7.5 |
| 3 | Fe—6.0%B | 1010 | 7.5 |
| 4 | Fe—6.5%B | 1200 | 7.4 |
| 5 | Zirconia | 1300 | 6.0 |
| 6 | Fe—8.5%B | 1400 | 7.2 |
| 7 | Fe—10.0%B | 1600 | 7.1 |

Table 1 shows the steel members (workpieces) used in Experiment A. Table 2 shows the shots used in Experiment A.

Experiment B

The steel members (workpieces) were those made of SACM645 and subjected to gas nitriding, which were used in Experiment A. The shots were powders prepared by gas atomization and having a composition Fe-8.5% B, a cemented carbide shot, and aluminum shots. The Fe-8.5% B particles were classified into 0.02 mm, 0.05 mm, 0.1 mm, 0.5 mm, and 0.8 mm. The cemented carbide shot was a commercially available shot having a particle size of 0.1 mm. The alumina shots were commercially available shots having particle sizes of 0.1 mm and 0.6 mm. The cemented carbide shot had a hardness of 1400 HV and a density of 14.0 $Mg/m^3$. The alumina shots had a hardness of 1900 HV and a density of 4.0 $Mg/m^3$. Shot peening was performed using the same shot peening system as that used in Experiment A at projection pressures of 0.2 MPa, 0.4 MPa, 0.6 MPa, and 0.8 MPa for 10 seconds. The test pieces were rated for compressive residual stress as in Experiment A.

The test pieces impacted with the Fe-8.5% B shot, the cemented carbide shot, and the alumina shot having a particle size of 0.1 mm were subjected to heat treatment at 500° C. in a vacuum for 30 minutes. The Vickers hardness of the surfaces of the test pieces was measured before and after the heat treatment. A test piece that exhibited a decrease in hardness of 150 HV or more after the heat treatment was rated as poor. A test piece that exhibited a decrease in hardness of less than 150 HV after the heat treatment was rated as good.

The results for compressive residual stress in Experiment B are summarized in Table 3. The results for the variation in Vickers hardness after the heat treatment are summarized in Table 4. As shown in Table 3, compressive residual stresses of 2,200 MPa or more were achieved at general shot sizes and projection pressures under the conditions according to the present invention. The compressive residual stress after shot peening with the alumina shot, which had low density, was less than 2,200 MPa. As shown in Table 4, the surfaces of the test pieces according to the present invention exhibited a small decrease in Vickers hardness after the heat exposure.

TABLE 3

| No | Material | Particle size (mm) | Projection pressure (0.2 MPa) | Projection pressure (0.4 MPa) | Projection pressure (0.6 MPa) | Projection pressure (0.8 MPa) | Remarks |
|---|---|---|---|---|---|---|---|
| 1 | Fe—8.5%B | 0.02 | Good | Excellent | Excellent | Excellent | Inventive example |
| 2 | Fe—8.5%B | 0.05 | Good | Excellent | Excellent | Excellent | |
| 3 | Fe—8.5%B | 0.1 | Good | Excellent | Excellent | Excellent | |
| 4 | Fe—8.5%B | 0.5 | Good | Excellent | Excellent | Excellent | |
| 5 | Fe—8.5%B | 0.8 | Good | Excellent | Excellent | Excellent | |
| 6 | Cemented carbide | 0.1 | Good | Excellent | Excellent | Excellent | |
| 7 | Alumina | 0.1 | Poor | Poor | Poor | Poor | Comparative example |
| 8 | Alumina | 0.6 | Poor | Poor | Poor | Poor | |

TABLE 4

| No. | Material | Particle size (mm) | Projection pressure (0.2 MPa) | Projection pressure (0.4 MPa) | Projection pressure (0.6 MPa) | Projection pressure (0.8 MPa) | Remarks |
|---|---|---|---|---|---|---|---|
| 1 | Fe—8.5%B | 0.1 | Good | Good | Good | Good | Inventive example |

TABLE 4-continued

| No. | Material | Particle size (mm) | Projection pressure (0.2 MPa) | Projection pressure (0.4 MPa) | Projection pressure (0.6 MPa) | Projection pressure (0.8 MPa) | Remarks |
|---|---|---|---|---|---|---|---|
| 2 | Cemented carbide | 0.1 | Good | Good | Good | Good | Inventive example |
| 3 | Alumina | 0.1 | Poor | Poor | Poor | Poor | Comparative example |

Table 3 shows the results for compressive residual stress in Experiment B. Table 4 shows the results for the decrease in Vickers hardness after the heat treatment in Experiment B.

As described above, the use of a shot having high hardness and a workpiece having high hardness in the present invention provides an unprecedentedly high compressive residual stress of 2,200 MPa or more. In this process, the treated surface is nanocrystallized by severe plastic deformation, and many of the interstitial elements are present as impurities in oversaturated amounts between the crystal grains. After heat exposure, these elements form ultrafine compound grains that are dispersed to pin the nanocrystalline grains, thereby reducing the decrease in hardness with increasing temperature. The shot peening process according to the present invention thus has pronounced advantages.

The invention claimed is:

1. A shot peening process comprising the steps of:

providing a steel member having a surface with a Vickers hardness of 920 HV or more; and projecting a shot excluding cemented carbide against the steel member, the shot having a Vickers hardness of 1000 HV or more and a density of 5.5 $Mg/m^3$ or more, and the shot satisfying the following relationship:

$$HV_{shot} \geq 0.4 \times HV_{steel} + 620$$

wherein $HV_{shot}$ is the Vickers hardness (HV) of the shot, and $HV_{steel}$ is the Vickers hardness (HV) of the surface of the steel member.

2. The process according to claim 1, wherein the shot further satisfies the following relationship:

$$HV_{shot} > 0.4 \times HV_{steel} + 720$$

wherein $HV_{shot}$ is the Vickers hardness (HV) of the shot, and $HV_{steel}$ is the Vickers hardness (HV) of the surface of the steel member.

3. The process according to claim 1, wherein the shot further satisfies the following relationship:

$$HV_{shot} > 0.4 \times HV_{steel} + 820$$

wherein $HV_{shot}$ is the Vickers hardness (HV) of the shot, and $HV_{steel}$ is the Vickers hardness (HV) of the surface of the steel member.

4. The process according to claim 1, wherein the shot has a Vickers hardness of more than 1100 HV.

5. The process according to claim 1, wherein the shot has a Vickers hardness of more than 1200 HV.

6. The process according to claim 1, wherein the shot has a density of more than 6.0 $Mg/m^3$.

7. The process according to claim 1, wherein the shot has a density of more than 7.0 $Mg/m^3$.

8. The process according to claim 1, wherein the surface of the steel member has a Vickers hardness of more than 950 HV.

9. The process according to claim 1, wherein the surface of the steel member has a Vickers hardness of more than 1000 HV.

* * * * *